US008640675B2

(12) United States Patent
Ricco et al.

(10) Patent No.: US 8,640,675 B2
(45) Date of Patent: Feb. 4, 2014

(54) FUEL INJECTOR PROVIDED WITH A METERING SERVOVALVE OF A BALANCED TYPE FOR AN INTERNAL-COMBUSTION ENGINE

(75) Inventors: Mario Ricco, Casamassima (IT); Raffaele Ricco, Valenzano (IT); Sergio Stucchi, Valenzano (IT); Onofrio De Michele, Valenzano (IT)

(73) Assignee: C.R.F. Societa Consortile per Azioni (IT)

( * ) Notice: Subject to any disclaimer, the term of this patent is extended or adjusted under 35 U.S.C. 154(b) by 1259 days.

(21) Appl. No.: 12/491,656

(22) Filed: Jun. 25, 2009

(65) Prior Publication Data

US 2009/0320802 A1 Dec. 31, 2009

(30) Foreign Application Priority Data

Jun. 27, 2008 (EP) ..... 08425459

(51) Int. Cl.

| | |
|---|---|
| ***B05B 1/30*** | (2006.01) |
| ***F02M 45/10*** | (2006.01) |
| ***F02M 51/00*** | (2006.01) |
| ***B05B 1/34*** | (2006.01) |

(52) U.S. Cl.

USPC ..... 123/472; 123/467; 123/468; 123/476; 123/494; 123/499; 123/502; 239/585.1; 239/585.5; 239/93; 239/586; 239/472; 239/467; 239/468; 239/476; 239/494

(58) Field of Classification Search

USPC ..... 239/96, 93, 95, 97, 585.5, 586; 123/472, 476, 468, 490, 494, 499, 502

See application file for complete search history.

(56) References Cited

U.S. PATENT DOCUMENTS

| | | | | |
|---|---|---|---|---|
| 4,850,521 | A * | 7/1989 | Servant | 277/614 |
| 6,375,098 | B1 * | 4/2002 | Fuseya et al. | 239/533.11 |
| 7,527,036 | B2 * | 5/2009 | Ricco et al. | 123/467 |
| 7,748,644 | B2 * | 7/2010 | Ricco et al. | 239/92 |
| 2002/0003176 | A1 * | 1/2002 | Muller-Girard et al. | 239/585.1 |
| 2003/0106533 | A1 * | 6/2003 | Crofts et al. | 123/446 |
| 2003/0189112 | A1 * | 10/2003 | Fukutomi et al. | 239/585.1 |

(Continued)

FOREIGN PATENT DOCUMENTS

| | | |
|---|---|---|
| DE | 102004041238 | 3/2006 |
| DE | 102006049885 | 4/2008 |

(Continued)

OTHER PUBLICATIONS

EP Search Report.

*Primary Examiner* — Stephen K Cronin
*Assistant Examiner* — Raza Najmuddin
(74) *Attorney, Agent, or Firm* — The Belles Group, P.C.

(57) ABSTRACT

A fuel injector has an injector body and a control rod, which is movable in the injector body along an axis for controlling opening/closing of a nozzle that injects fuel in an engine cylinder; the injector body houses a metering servovalve, provided with a control chamber and with an open/close element of a balanced type, axial sliding of which causes a variation in pressure in the control chamber; the metering servovalve comprises a valve body made of two pieces coaxially coupled to one another via a deformable ring, which defines also a gasket for guaranteeing fluid tightness between the two pieces and maintains in a fixed position a disk on which a calibrated restriction is made.

16 Claims, 2 Drawing Sheets

(56) References Cited

U.S. PATENT DOCUMENTS

| | | | | |
|---|---|---|---|---|
| 2003/0230649 | A1* | 12/2003 | Nagaoka et al. | 239/585.1 |
| 2004/0026540 | A1* | 2/2004 | Haeberer et al. | 239/585.1 |
| 2004/0195384 | A1* | 10/2004 | Bierstaker et al. | 239/533.2 |
| 2004/0256499 | A1* | 12/2004 | Frank et al. | 239/585.1 |
| 2005/0056712 | A1* | 3/2005 | Fukutomi | 239/585.1 |
| 2005/0087624 | A1 | 4/2005 | Neumaier | |
| 2005/0284447 | A1* | 12/2005 | Usui et al. | 123/468 |
| 2006/0011736 | A1* | 1/2006 | Ricco et al. | 239/96 |
| 2007/0205302 | A1* | 9/2007 | Ricco et al. | 239/96 |
| 2009/0032621 | A1* | 2/2009 | Ricco et al. | 239/533.3 |
| 2011/0000464 | A1* | 1/2011 | Kannan et al. | 123/470 |

FOREIGN PATENT DOCUMENTS

| | | | |
|---|---|---|---|
| DE | 102006057935 | | 6/2008 |
| EP | 1612399 | | 1/2006 |
| EP | 1612403 | | 1/2006 |
| EP | 1621764 | | 2/2006 |
| EP | 1707798 | | 10/2006 |
| EP | 1731752 | | 12/2006 |
| EP | 1916411 | | 4/2008 |
| EP | 2022977 | A1 * | 2/2009 |

* cited by examiner

FUEL INJECTOR PROVIDED WITH A METERING SERVOVALVE OF A BALANCED TYPE FOR AN INTERNAL-COMBUSTION ENGINE

CROSS-REFERENCE TO RELATED PATENT APPLICATIONS

The present patent application claims priority under 35 U.S.C. §119 to European Patent Application No. 08425459.8, filed Jun. 27, 2008, the entirety of which is hereby incorporated by reference.

FIELD OF THE INVENTION

The present invention relates to a fuel injector provided with a metering servovalve of a balanced type for an internal-combustion engine.

BACKGROUND OF THE INVENTION

Known from the European patent No. EP1612403 is a fuel injector for an internal-combustion engine comprising:

- a casing, ending with a nozzle for injecting fuel into a corresponding engine cylinder;
- a movable needle for closing and opening the nozzle;
- a rod, housed in the casing and slidable along its own axis for controlling the movement of the needle; and
- a metering servovalve, housed in the casing and comprising:

a) an actuator;

b) a control chamber, which communicates with an inlet for the fuel and with a passage for outlet of the fuel, which has a calibrated portion and the pressure of which controls axial sliding of the rod;

c) an open/close element, defined by a sleeve that is axially movable under the action of the actuator between a closing position, in which it closes the discharge channel, and an opening position, in which it leaves the discharge channel open, so as to vary the pressure in the control chamber in order to close and open the nozzle; and d) an axial stem, placed in a position fixed with respect to the casing and having an outer lateral surface, through which the discharge channel exits.

The sleeve is mounted on the outer lateral surface of the axial stem in an axially slidable and substantially fluid-tight way and, in the closing position, closes the discharge channel so as to be subjected to a zero axial resultant by the pressure of the fuel. In said system, where the metering servovalve and the open/close element defined by the sleeve are of the so-called "balanced" type, the forces required of the actuator, and, consequently, the overall dimensions, are small. In particular, even with minor lifts of the open/close element, it is possible to obtain large passage cross-sections of the fuel, with consequent advantages in the dynamic behaviour of the injector, i.e., without any phenomena of so-called "rebound" of the open/close element at the end of the travel of opening and closing.

The metering servovalve has a so-called valve body made up of three pieces, namely, a tubular guide body, which defines laterally the control chamber and axially guides the rod, a distribution body comprising the axial stem, and a disk, which is placed axially between the tubular guide body and the distribution body and has the aforesaid calibrated portion made axially.

The known solution just described is far from satisfactory in so far as it is relatively complex to produce in a precise way to guarantee tightness in regard to the fuel that flows from the control chamber into the outlet passage. In fact, said known solution requires grinding operations on as many as four fluid-tight metal surfaces, i.e., on the surfaces in the areas of axial coupling between the distribution body and the disk and between the disk and the tubular guide body.

In addition, the theoretical average diameter in which fluid tightness between the tubular guide body and the disk is achieved is relatively large so that the pressure acting on a surface having said diameter also causes large axial forces, with the consequent risk of considerable deformations, in particular on the disk. Said deformations, on the one hand, cause errors in the lift of the open/close sleeve with respect to what is envisaged in the design stage and, on the other hand, tend to cause a further increase in the theoretical average diameter of fluid tightness between the deformed disk and the tubular guide body, hence causing progressive deterioration of the situation.

In addition, the operations of machining, handling, and assembly of the three pieces that constitute the valve body are considerably long and costly. In order to attempt to overcome these drawbacks, it is known, for example from the European patent No. EP1621764di, to make the valve body of the metering valve of a single piece.

This solution entails extremely high costs to guarantee very strict geometrical tolerances, in particular as regards the shaft of the axial stem, which must coincide (with tolerances of the order of a micron) with the axis of the blind hole in which the rod is guided.

In addition, once again in the case of a valve body made of a single piece, it is extremely complex to produce more than two calibrated portions placed in series to one another, in so far as it would be necessary, in theory, to force at least two additional inserts in an axial direction operating through the blind hole in which the rod is guided.

SUMMARY OF THE INVENTION

The aim of the present invention is to produce a fuel injector provided with a metering servovalve of a balanced type for an internal-combustion engine which will enable a simple and low-cost solution of the problems set forth above.

Provided according to the present invention is a fuel injector for an internal-combustion engine, the injector ending with a nozzle for injecting fuel in a corresponding engine cylinder and comprising:

- a hollow injector body, extending in an axial direction;
- a control rod, which is axially movable in said injector body for controlling opening/closing of said nozzle; and
- a metering servovalve, housed in said injector body and comprising:

a) an electro-actuator;

b) a valve body, fixed with respect to said injector body and comprising a first piece and at least one second piece;

c) a control chamber, defined by said control rod and by said first piece and communicating with an inlet and with a discharge channel, which is made in said first and second pieces and comprises at least one calibrated restriction;

d) an axial guide, forming part of said second piece and having a lateral surface, through which said discharge channel exits;

e) an open/close element, coupled to said lateral surface in a substantially fluid-tight way and so as to slide axially under the action of said electro-actuator between a closing position, in which it closes said discharge channel in such a way as to be subjected to a substantially zero resultant of axial force by the pressure of the fuel, and an opening position, in which it opens said discharge channel (42) so as to vary the pressure in said control chamber and, hence, cause axial displacement of said control rod; and f) a perforated body placed axially between said first piece and said second piece and delimiting radially an intermediate portion of said discharge channel;

said injector being characterized in that said perforated body is a deformable ring housed in at least one between said first and second pieces.

BRIEF DESCRIPTION OF THE DRAWINGS

For a better understanding of the present invention a preferred embodiment is now described, purely by way of non-limiting example, with reference to the attached drawings, wherein.

DETAILED DESCRIPTION OF THE INVENTION

Figure 1:
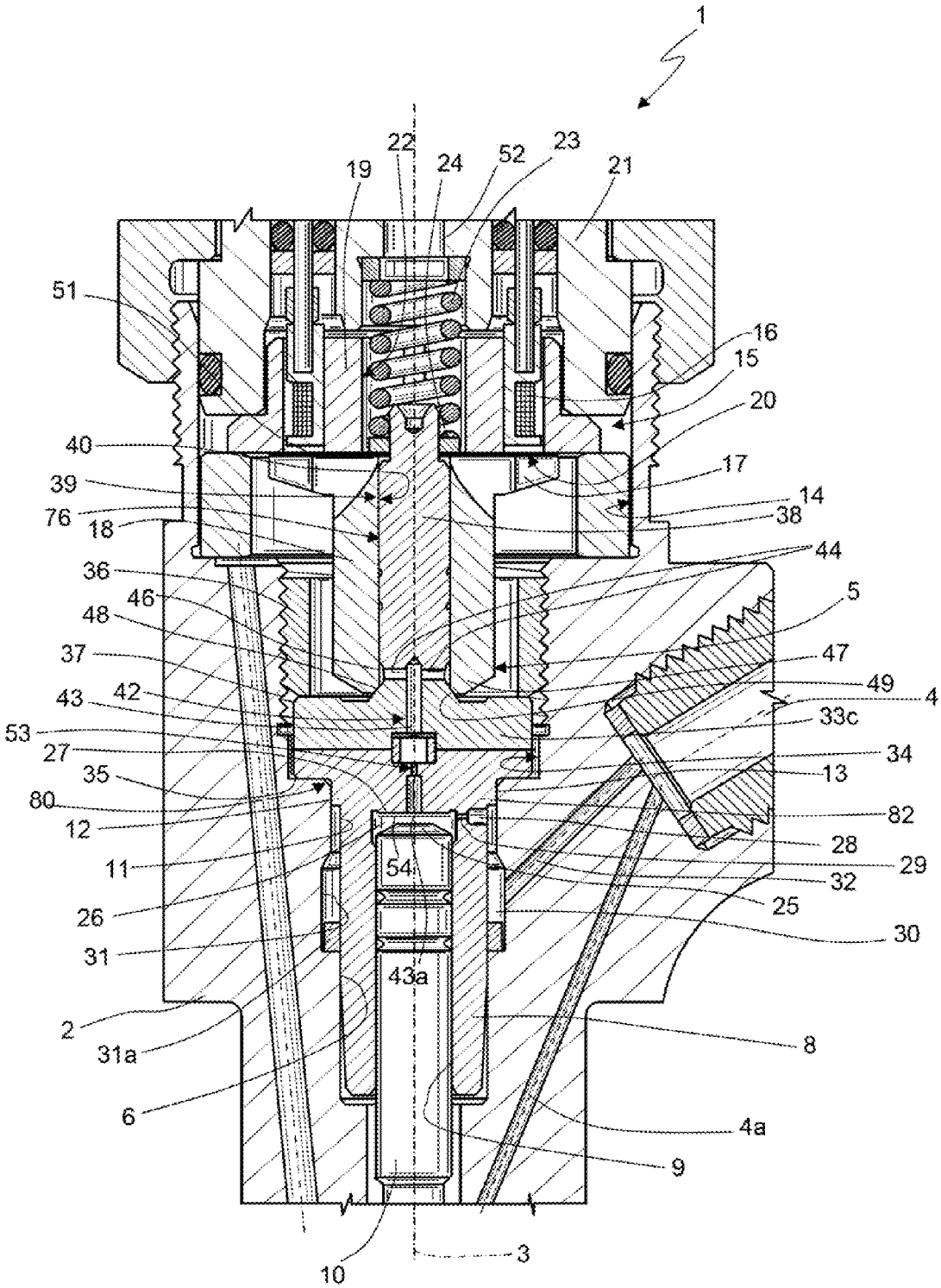
FIG. 1 shows, in a cross-sectional view and with parts removed, a preferred embodiment of the fuel injector provided with a metering servovalve of a balanced type for an internal-combustion engine, according to the present invention.

With reference to FIG. 1, the reference number 1 designates, as a whole, a fuel injector (partially illustrated) for an internal-combustion engine, in particular, a diesel engine. The injector 1 comprises a hollow body or casing 2, commonly referred to as "injector body", which extends along a longitudinal axis 3, and has a lateral inlet 4, designed to be connected to a channel for delivery of the fuel at high pressure, for example, at a pressure in the region of 1600 bar. The casing 2 ends with an injection nozzle (not visible in the figure), which is in communication with the inlet 4, through a channel 4*a*, and is designed to inject the fuel into a corresponding engine cylinder.

The casing 2 defines an axial cavity 6, housed in which is a metering servovalve 5, comprising a valve body made of two pieces designated by reference numbers 76 and 80.

The body 80 comprises: a tubular portion 8 defining a blind axial hole 9; and an end portion 82, provided with a centring projection 12, which extends in cantilever fashion radially with respect to an outer cylindrical surface 11 of the portion 8 and is coupled to an internal surface 13 of the body 2. The portion 82 is then provided with an outer flange 33*d* (FIG. 2), which projects radially with respect to the projection 12, is housed in a portion 34 of the cavity 6 of oversize diameter and is placed axially in contact against an internal shoulder 35 of the cavity 6.

A control rod 10 is axially slidable in a fluid-tight way in the hole 9 for controlling in a way known and not illustrated an open/close needle, which closes and opens the injection nozzle.

The casing 2 defines another cavity 14, which is coaxial with respect to the cavity 6 and houses an actuator 15, which comprises an electromagnet 16 and a notched-disk anchor 17 controlled by the electromagnet 16. The anchor 17 is made of a single piece with a sleeve 18, which extends along the axis 3. The electromagnet 16, instead, comprises a magnetic core 19, which has a surface 20 perpendicular to the axis 3 and defines an axial arrest for the anchor 17, and is kept in position by a support 21.

The actuator 15 has an axial cavity 22, housing a helical compression spring 23, which is pre-loaded so as to exert on the anchor 17 a thrust in an axial direction opposite to the attraction exerted by the electromagnet 16. The spring 23 has an end resting against an internal shoulder of the support 21, and another end acting on the anchor 17 via the axial interposition of a washer 24.

The metering servovalve 5 comprises a control chamber 26 delimited radially by the lateral surface of the hole 9 of the tubular portion 8. The control chamber 26 is delimited axially, on one side, by a end surface 25 of the rod 10 advantageously having the shape of a truncated cone and, on the other side, by an end surface 27 of the hole 9.

The control chamber 26 communicates permanently with the inlet 4 through a channel 28 made in the portion 8, for receiving fuel under pressure. The channel 28 comprises a calibrated portion 29 and exits, on one side, into the control chamber 26 in the vicinity of the end surface 27 and, on the other side, in an annular chamber 30, defined radially by the surface 11 of the portion 8 and by an annular groove 31 of the internal surface of the cavity 6. The annular chamber 30 is delimited axially, on one side, by the projection 12 and, on the other side, by a gasket 31*a*. A channel 32 is made in the body 2, is in communication with the inlet 4 and exits in the annular chamber 30.

The body 76 is made of a single piece, comprises a base defining an outer flange 33*c* and is delimited axially by a surface 77 (FIG. 2), which is placed so that it rests axially against the portion 82. A threaded ring-nut 36 is screwed on an internal thread 37 of the portion 34 so as to grip axially in a fixed position the outer flange 33*d* between the flange 33*c* and the shoulder 35 and, hence, the surface 77 against the portion 82, and to guarantee fluid tightness between the body 80 and the casing 2.

The body 76 also comprises an element for guiding the anchor 17 and the sleeve 18. Said element is defined by a substantially cylindrical stem 38 having a diameter much smaller than that of the flange 33*c*. The stem 38 extends in cantilever fashion from the base along the axis 3 on the opposite side with respect to the body 80, i.e., towards the cavity 22. The stem 38 is delimited on the outside by a cylindrical lateral surface 39, which guides axial sliding of the sleeve 18. In particular, the sleeve 18 has a cylindrical internal surface 40, coupled to the lateral surface 39 of the stem 38 substantially in a fluid-tight way, i.e., by means of a coupling with appropriate diametral play, for example of less than 4 μm, or else by means of interposition of specific seal elements.

The control chamber 26 communicates permanently with a fuel-discharge channel, designated as a whole by the reference number 42.

The channel 42 comprises a blind axial portion 43, made along the axis 3 in the body 76 (in part in the base and in part in the stem 38). The channel 42 also comprises at least one outlet portion 44, which is radial and exits, on one side, into the portion 43 and, on the other side, into a chamber 46 defined by an annular groove on the lateral surface 39 of the stem 38.

In particular, two portions 44 are provided that are diametrally opposite to one another.

The chamber 46 is made in an axial position adjacent to the base and is opened/closed by an end portion of the sleeve 18, which defines an open/close element 47 for the channel 42. In particular, the open/close element 47 ends with an internal surface 48 having the shape of a truncated cone, which is designed to engage a surface 49 shaped like a truncated cone radiusing between the base and the stem 38 to define an area of sealing.

The sleeve 18 slides on the stem 38 together with the anchor 17 between an advanced end-of-travel position and a retracted end-of-travel position. In the advanced end-of-travel position, the open/close element 47 closes the chamber 46 and hence the outlet of the portions 44 of the channel 42. In the retracted end-of-travel position, the open/close element 47 opens the chamber 46 sufficiently to enable the portions 44 to discharge the fuel of the control chamber 26 through the channel 42 and the chamber 46. The section of passage left open by the open/close element 47 has a profile shaped like a truncated cone and is at least three times larger than the section of passage of an individual portion 44.

The advanced end-of-travel position of the sleeve 18 is defined by arrest of the surface 48 of the open/close element 47, which bears upon the surface shaped like a truncated cone 49 for radiusing between the base and the stem 38. Instead, the retracted end-of-travel position of the sleeve 18 is defined by arrest of the anchor 17 axially bearing upon the surface 20 of the core 19, with the interposition of a non-magnetic gap plate 51. In the retracted end-of-travel position, the chamber 46 is set in communication with a discharge channel of the injector (not illustrated) through an annular passage between the ring-nut 36 and the sleeve 18, through the notches of the anchor 17, through the cavity 22, and through an opening 52 of the support 21.

When the electromagnet 16 is energized, the anchor 17 is displaced towards the core 19 together with the sleeve 18 so that the open/close element 47 opens the chamber 46. The fuel is then discharged from the control chamber 26: in this way, the pressure of the fuel in the control chamber 26 decreases, causing axial displacement of the rod 10 towards the end surface 27 and hence opening of the injection nozzle.

Instead, by de-energizing the electromagnet 16, the spring 23 carries the anchor 17, together with the open/close element 47, into the advanced end-of-travel position. In this way, the chamber 46 is closed, and the fuel under pressure, entering the channel 28, restores the high pressure in the control chamber 26 so that the rod 10 moves away from the end surface 27 and governs closing of the injection nozzle. In the advanced end-of-travel position, the fuel exerts on the sleeve 18 a substantially zero axial resultant of thrust, given that the pressure in the chamber 46 acts only radially on the lateral surface 40 of the sleeve 18.

In order to control the rate of the variation of pressure in the control chamber 26 upon opening and closing of the open/close element 47, the channel 42 comprises one or more calibrated restrictions.

The term "restriction" is intended as a channel portion in which the passage section globally available for the fuel is smaller than the passage section that the fuel flow encounters upstream and downstream of this channel portion. In particular, if the fuel flows in a single hole, the restriction is defined by said single hole; on the other hand, if the fuel flows in a plurality of holes which are located in parallel and, therefore, are subjected to the same pressure drop between upstream and downstream, the restriction is defined by the entirety of said holes.

In particular regarding the calibration, for holes having a relatively small diameter, it is obtained in a precise way by means of an operation of finishing of an experimental nature, which is carried out by causing an abrasive liquid to flow in the hole made previously (for example, by means of electro-erosion or by means of laser), setting a pressure upstream and a pressure downstream of said hole, and detecting the flowrate. The flowrate tends to increase progressively with the abrasion caused by the liquid on the lateral surface of the hole (hydro-erosion or hydro-abrasion), until a pre-set design value is reached. At this point, the flow is interrupted: in use, having upstream of the hole a pressure equal to the one set up during the finishing operation, the final passage cross-section obtained comes to define a drop in pressure equal to the difference of pressure set between the section upstream and the section downstream of the hole during the operation of finishing and a flowrate of fuel equal to the pre-set design value of flowrate.

If the calibrated restrictions are more than one, they are placed in series one after the other.

Figure 2:
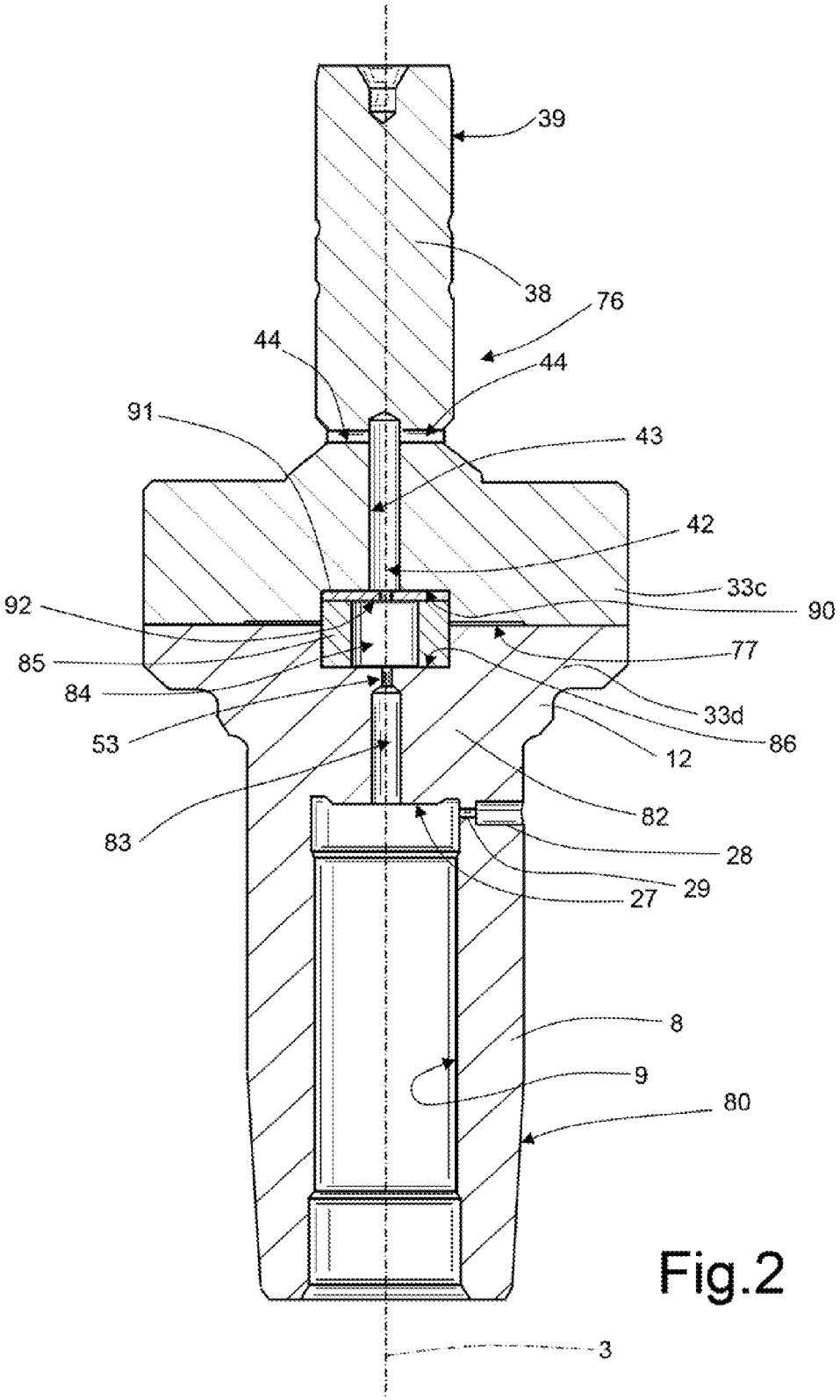
FIG. 2 shows a detail of FIG. 1, at an enlarged scale.

With reference to FIG. 2, the restrictions that are placed in series to one another along the channel 42 (the diameter of the restrictions is shown only qualitatively and not in scale) are three: one is defined by the entirety of the two portions 44; another is designated by the reference number 53 and is made axially in the portion 82 of the body 80; the last is defined by a hole 92 made in an element additional or separate with respect to the bodies 80 and 76, in particular in a disk 91 housed in the body 76.

For example, the restrictions 53 and 92 of the channel 42 have a diameter comprised between 150 and 300 μm, whilst the portion 43 of the channel 42 is made in the body 76 using a normal drill, without particular precision, to obtain a diameter that is at least four times larger than the diameter of the calibrated restrictions.

The drop in pressure, which occurs, in use, between the control chamber 26 and the discharge channel when the open/close element 47 is in the opening position, is divided into as many pressure drops as are the calibrated restrictions placed in series along the channel 42.

According to a variant (not illustrated), the calibrated restriction 53 is made in an insert coupled to the body 80, for example, fitted axially in the portion 82 on the side facing the control chamber 26, or else on the side facing the surface 77, and has an axial length equal or else smaller than that of said insert.

According to another variant (not illustrated), only one portion 44 is provided with a calibrated passage cross-section substantially equal to the sum of the passage cross-sections of the individual portions 44.

In addition, as an alternative to the portions 44, the calibrated restriction of the body 76 could be defined by inclined outlet portions, or else by a blind axial portion constituting the end part of the portion 43.

The opposite ends of the calibrated restriction 53 exit into respective portions 83, 84 of the channel 42. The portions 83, 84 are coaxial and have a diameter greater than that of the calibrated restriction 53 and of the same order of magnitude as the portion 43. The portion 83 is defined by a hole in the portion 82 and communicates directly with the control chamber 26; the portion 84, instead, is defined by the internal space of a sealing ring 85, which is made of plastic material, preferably of a material known under the brandname "turcite" (registered trademark), is consequently deformable to an extent greater that that of the metal material of the bodies 76 and 80, and is housed in part in a cylindrical seat 86 of the portion 82 and in part in a cylindrical seat 90 of the base of the body 76.

The seats 86 and 90 are coaxial and have the same diameter. The seat 90 houses the disk 91, which is kept so that it rests axially against the end of the seat 90 by the seal ring 85, which remains compressed axially between the end of the seat 86 and the disk 91.

The ring 85 is cylindrical and has a rectangular or square radial section, with outer diameter substantially equal to the diameter of the seats 90 and 86, and defines a centring member for coupling the two bodies 80 and 76 to one another in coaxial positions. In other words, the ring 85 performs three functions: axial centring between the bodies 80 and 76 during coupling; seal between the bodies 80 and 76 around the flow of fuel in the channel 42; and positioning of the disk 91 in the seat 90.

In the assembly step, the deformability of the ring 85 enables a slight recovery of possible errors of misalignment between the bodies 80 and 76 so that the precision required in the coaxially between the hole 9 and the axial stem 38 is smaller than the one required if the valve body constituted by the bodies 76 and 80 were made of a single piece.

The fact of producing the valve body in two pieces enables machining, inspection, and cleaning of the blind axial portion 43 before insertion of the disk 91 in the seat 90 in a relatively simple way. It is then possible to set between the bodies 76 and 80 in an extremely simple and fast way the additional element 91 on which the calibrated restriction 92 is made and to maintain said additional element in a fixed position.

The provision of the restriction 92, given that it is made on a disk, for example, via a process of photoshearing, is simple and inexpensive.

Thanks to the elastic deformation by compression, the ring 85 can be used to obtain tightness in an effective way between the bodies 80 and 76. The diameter in which said tightness is obtained is relatively small, thanks to the contained dimensions and to the central position of the ring 85 so that the pressure of the fuel acts axially over a small area, with consequent limitation of the axial thrusts exerted by the fuel between the bodies 76 and 80 as compared to the known solutions without deformable elements. Consequently, the lift of the sleeve 18 corresponds to the one envisaged in the design stage and remains substantially the same throughout the service life of the injector.

Finally, it is clear that modifications and variations can be made to the injector 1 described and illustrated herein without thereby departing from the sphere of protection of the present invention, as defined in the annexed claims.

In particular, the metering servovalve 5 of a balanced type could comprise an open/close element defined by an axial pin slidable in a sleeve fixed with respect to the casing 2 and defining the end part of the channel 42.

The actuator 15 could be replaced by a piezoelectric actuator, which, when subjected to a voltage, increases its own axial dimension to actuate the sleeve 18 in such a way as to open the outlet of the channel 42.

In addition, the chamber 46 could be dug at least in part in the surface 40, but once again with a conformation such that the open/close element 47 defined by the sleeve 18 is subjected to a zero resultant of pressure along the axis 3 when it is placed in a closing end-of-travel position.

The axes of the portions 44 could lie on planes that differ from one another, and/or could not be all spaced equally apart around the axis 3, and/or the calibrated holes could be limited only to one part of the portions 44.

The channel 42 could not be symmetrical with respect to the axis 3; for example, the portions 44 could have cross-sections that differ from one another and/or diameters that differ from one another, but once again calibrated for generating an appropriate drop in pressure to cause a flowrate of fuel disposed of that is balanced around the axis 3 and constant in time.

The invention claimed is:

1. A fuel injector for an internal-combustion engine; the injector ending with a nozzle for injecting fuel in a corresponding engine cylinder and comprising:

a hollow injector body extending in an axial direction;

a control rod axially movable in said injector body for controlling opening/closing of said nozzle; and a metering servovalve housed in said injector body and comprising:

an electro-actuator;

a valve body, fixed with respect to said injector body and comprising a first and at least one second piece;

a control chamber defined by said control rod and by said first piece and communicating with an inlet and with a discharge channel, which is made in said first and second pieces and comprises at least one calibrated restriction, an axial guide forming part of said second piece and having a lateral surface through which said discharge channel exits;

an open/close element coupled to said lateral surface substantially in a fluid-tight way and so as to slide axially under the action of said electro-actuator between a closing position, in which it closes said discharge channel in such a way as to be subjected to a substantially zero resultant of axial force by the pressure of the fuel, and an opening position, in which it opens said discharge channel so as to vary the pressure in said control chamber and, hence, cause axial displacement of said control rod;

a perforated body placed axially between said first piece and said second piece and delimiting radially an intermediate portion of said discharge channel, wherein said perforated body is a deformable ring housed in at least one of said first and second pieces; and an additional element defining said calibrated restriction and placed so that it rests axially against one of said first and second pieces, on one side, and against said deformable ring, on the other side.

2. The injector according to claim 1, wherein said deformable ring is in part housed in a first seat made in said first piece and in part housed in a second seat made in said second piece to maintain said first and second pieces in coaxial positions with respect to one another.

3. The injector according to claim 2, wherein said first and seco seats and said deformable ring are cylindrical.

4. The injector according to claim 1, wherein said deformable ring is elastically deformable and is compressed to guarantee fluid tightness between said first and second pieces.

5. The injector according to claim 1, wherein said additional element is a disk axially resting against one of said first piece and said second piece.

6. The injector according to claim 1, wherein said discharge channel comprises three calibrated restrictions in series, two of which are placed in said axial direction and one of which is defined, by said additional element.

7. The injector according to claim 1, wherein said discharge channel comprises a first calibrated restriction and a second calibrated restriction placed in series, the first restriction being placed in said axial direction and the second restriction being made in a radial portion of said discharge channel.

8. The injector according to claim 7, wherein said second restriction is made up of two or more restrictions in parallel, made radially with respect to said axial direction.

9. The injector according to claim 1, wherein said first and second pieces are arranged so that they directly bear axially upon one another.

10. The injector according to claim 1, wherein said deformable ring is made of plastic material.

11. The injector according to claim 10, wherein said deformable ring is made of "turcite".

12. The injector according to claim 1, wherein said axial guide is defined by a stem and said open/close element is defined by a sleeve.

13. A fuel injector for an internal-combustion engine; the injector ending with a nozzle for injecting fuel in a corresponding engine cylinder and comprising:

a hollow injector body extending in an axial direction;

a control rod axially movable in said injector body for controlling opening and closing of said nozzle; and a metering servovalve housed in said injector body and comprising:

an electro-actuator;

a valve body, fixed with respect to said injector body and comprising a first and at least one second piece;

a control chamber defined by said control rod and by said first piece and communicating with an inlet and with a discharge channel, which is made in said first and second pieces and comprises at least a first calibrated restriction and a second calibrated restriction;

an axial guide forming part of said second piece and having a lateral surface through which said discharge channel exits;

an open/close element coupled to said lateral surface substantially in a fluid-tight way and so as to slide axially under the action of said electro-actuator between a closing position, in which it closes said discharge channel in such a way as to be subjected to a substantially zero resultant of axial force by the pressure of the fuel, and an opening position, in which it opens said discharge channel so as to vary the pressure in said control chamber and, hence, cause axial displacement of said control rod;

a perforated body having a first end and an opposite second end placed axially between said first piece and said second piece and delimiting radially an intermediate portion of said discharge channel, wherein a plane that extends substantially perpendicular to the axial direction intersects said perforated body and one of said first or second pieces; and wherein the first calibrated restriction is located adjacent the first end of the perforated body and the second calibrated restriction is located adjacent the second end of the perforated body.

14. The injector according to claim 13 wherein a portion of a surface of said first piece is in surface contact with a portion of a surface of said second piece.

15. A fuel injector for an internal-combustion engine; the injector ending with a nozzle for injecting, fuel in a corresponding engine cylinder and comprising:

a hollow injector body extending in an axial direction;

a control rod axially movable in said injector body for controlling opening and closing of said nozzle; and a metering servovalve housed in said injector body and comprising:

an electro-actuator;

a valve body, fixed with respect to said injector body and comprising a first and at least one second piece;

a control chamber defined by said control rod and by said first piece and communicating with an inlet and with a discharge channel, which is made in said first and second pieces and comprises at least one calibrated restriction;

an axial guide forming part of said second piece and having a lateral surface through which said discharge channel exits;

an element coupled to said lateral surface so as to slide axially under the action of said electro-actuator between a closing position, in which it closes said discharge channel in such a way as to be subjected to a substantially zero resultant of axial force by the pressure of the fuel, and an opening position, in which it opens said discharge channel so as to vary the pressure in said control chamber and, hence, cause axial displacement of said control rod;

an annular body housed in the valve body and delimiting radially an intermediate portion of said discharge channel, wherein said valve body circumferentially surrounds said annular body; and a disk positioned axially between said annular body and one of said first and second pieces, wherein said disk comprises a calibrated restriction.

16. The injector according to claim 13 further comprising a disk positioned axially between said perforated body and one of said first and second pieces, wherein said disk comprises the first calibrated restriction.

* * * * *